United States Patent [19]

Chabria

[11] Patent Number: 4,628,418

[45] Date of Patent: Dec. 9, 1986

[54] MULTI-PURPOSE MINIATURE FLASHLIGHT DEVICE

[75] Inventor: Paul R. Chabria, West Chicago, Ill.

[73] Assignee: Press-A-Lite Corporation, West Chicago, Ill.

[21] Appl. No.: 829,314

[22] Filed: Feb. 14, 1986

[51] Int. Cl.[4] ..... F21L 7/00

[52] U.S. Cl. ..... 362/116; 362/189; 362/191; 362/398; 362/205; 224/903

[58] Field of Search ..... 362/116, 189, 200, 202, 362/204, 205, 208, 190, 191, 398; 224/903

[56] References Cited

U.S. PATENT DOCUMENTS

| | | | |
|---|---|---|---|
| 3,863,062 | 11/1975 | Caron | 362/116 |
| 4,032,773 | 6/1977 | Halliday et al. | 362/189 |
| 4,443,833 | 4/1984 | Fazzino | 362/189 |
| 4,449,474 | 5/1984 | Mariol | 362/116 |
| 4,517,627 | 5/1985 | Bradford | 362/191 |

*Primary Examiner*—William A. Cuchlinski, Jr.
*Assistant Examiner*—D. M. Cox
*Attorney, Agent, or Firm*—Lee, Smith & Zickert

[57] ABSTRACT

A multi-purpose miniature pocket flashlight having a flexible case that contains a cartridge and lamp assembly. The cartridge is capable of holding a pair of batteries in association with a spring switch arm operable by squeezing the flexible casing to complete the electrical circuit and illuminate the lamp. The lamp and batteries are removable and replaceable by the provision of a removable cap means at either of the ends of said casing. The flashlight further includes a mounting magnet arranged within the case adjacent the cartridge whereby the flashlight may be magnetically secured against a metallic wall, for example. The invention also includes a bottom cap for said flexible casing that is designed to provide a watch chamber below said cartridge. The cap has a centrally open bottom wall that opens to said chamber. A watch means, having a casing shaped to nest within said watch chamber, is arranged therein so that its time display is positioned at said bottom wall opening to be visible from the bottom of the flashlight. The watch means is fully removable from said flexible casing.

16 Claims, 12 Drawing Figures

13
3.
12
2.
2.
26
10
27
11
24
30
25
20
4.
4.
19
22
16
15
31
17
22'
18
14
23
3.
21

13
10
12
11
26
24
20
22
15
16
31
18
14
23
21

20
11
6.
30
24
29
25
28
26
6.
14

15
31
11
17
16
19
18
23
14
21
22

10
14
13
11

29
26

MULTI-PURPOSE MINIATURE FLASHLIGHT DEVICE

BACKGROUND AND SUMMARY OF THE INVENTION

The present invention generally relates to miniature pocket flashlights of the type as described in my co-pending application Ser. No. 765,548, filed Aug. 14, 1985. The invention provides additional novel features for such a device and improved means for replacing a lamp and batteries all in a solderless construction.

It will be understood that the desirable design for a miniature flashlight includes a flexible casing that is squeezed by the user to complete an electric circuit and illuminate a lamp. The usefulness lies in the ability to have a lighting means available when opening a door during the evening hours, or attempting to read a mailbox name, locate a dropped item, etc. For such devices it would be desirable to incorporate a mounting magnet into the design whereby the flashlight may be temporarily stored against a refrigerator, wall, automobile dashboard, and the like. In further providing convenience of use, it would also be beneficial for the miniature flashlight to include a clock means, separately operable from the lamp, and key chain attachment means, so that in one compact unit the user may carry house and automobile keys, have a lamp to locate locks, a time piece, and magnetic mount for storage, all provided in a construction which allows for the replacement of expired batteries and lamps by simply removing either a top or bottom cap from a flexible jacket.

In summary, the invention may be described as a multi-purpose miniature flashlight comprising a battery-holding cartridge associating with a switch and lamp all of which are encased by a flexible jacket facilitating, by means of pressing the jacket against the switch, the completion of the lamp circuit for illumination. The lamp is mounted, in one embodiment, by screwing a threaded base portion thereof into a bracket arranged on the cartridge. In a second embodiment, the lamp base includes spade-like projections for insertion into snap-engageable connectors of a socket means. The socket means preferably includes bendable leads extending interiorly of the cartridge whereby to be in electrical communication with the batteries.

In all embodiments of the invention, the batteries may be of either the typical insulated variety, or the metallic jacket-type in which the whole cylindrical cannister of the battery comprises the negative terminal. In one form of the invention, the battery-holding cartridge is generally W-shaped whereby two concave battery-cradle portions open toward the same direction. At the opposite side of this style cartridge, a shape-conforming magnet is disposed to reside for substantially the full length thereof and have an outward side shaped to conform to the curvature of the inner surface of the flexible jacket encasing the cartridge. Thereby, the miniature flashlight may be placed against a metallic wall, automobile dashboard, refrigerator, etc., in handy position for use.

Another feature of the invention is the provision of a time piece, for example a digital watch, and casing therefor, accommodated adjacent the lamp-opposite end of the cartridge and secured thereat by means of a bottom cap cooperative with the open bottom end of the flexible jacket. The digital watch is separably operated by its own battery and the watch casing is also shaped to conform to the interior curved surface of the flexible case so to be securely nestled within the flashlight.

The replaceable bulb and battery systems, plus the provision of a time piece means, may be provided for both the typical W-shaped cartridge as well as an S-shaped cartridge as described in my said pending application Ser. No. 765,548—the latter cartridge conformation providing oppositely directed battery-holding cradles as would be understood.

Other advantages, features and uses of the invention will become apparent from the detailed description hereinafter taken in conjunction with the drawing.

DETAILED DESCRIPTION OF THE PREFERRED EMBODIMENT

Figure 1:
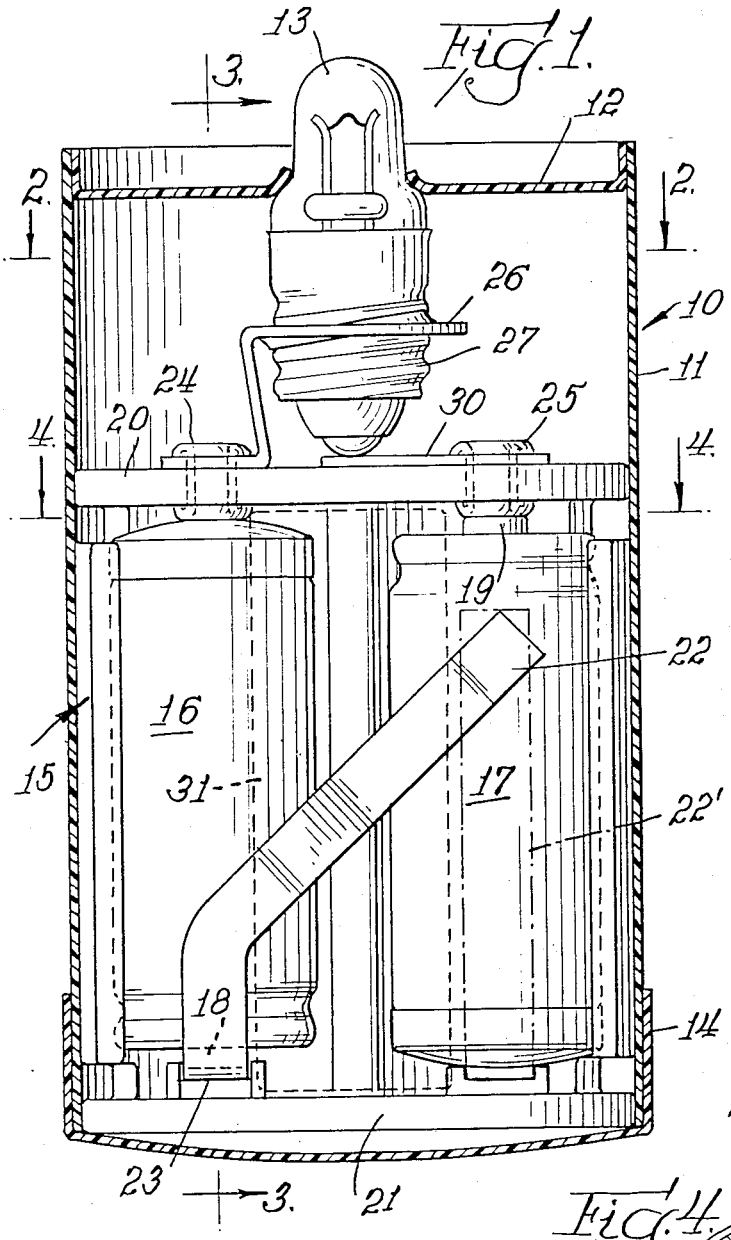
FIG. 1 is a central sectional view of the inventive flashlight taken on a vertical plane through its outer flexible casing and W-shaped cartridge illustrating the replaceable bulb and battery system including a pair of uninsulated batteries and a spring switch arm means for completion of the electric circuit to illuminate the lamp, and further showing the disposition of a mounting magnet at one side of the cartridge residing interiorly of the flexible jacket.

The drawing illustrating the preferred embodiment for the invention utilizes a switch arm means, batteries, and a cartridge therefor, capable of use with insulated or uninsulated-type batteries generally in accordance with my invention as described in co-pending application Ser. No. 765,548. These features are illustrated herein for the purposes of explanation so that the present multi-purpose miniature flashlight invention will be seen to be useful therewith, as well as capable of being used with other battery and switch arm devices utilizing a cartridge-type holding means.

Figure 3:
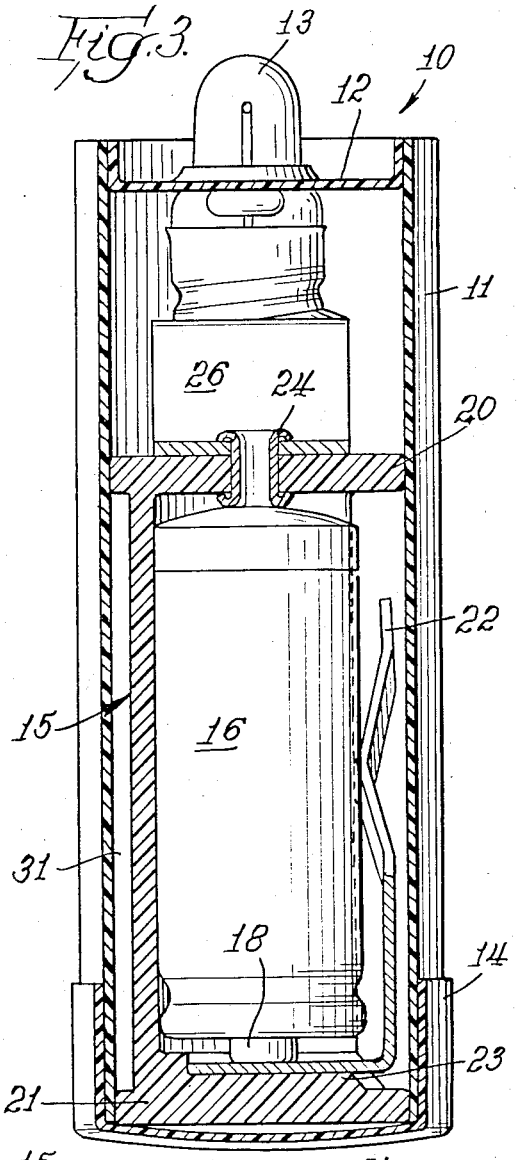
FIG. 3 is a sectional view of the flashlight taken along line 3—3 of FIG. 1 and showing a cartridge, one battery, lamp and the switch arm means within the flexible jacket in association with the mounting magnet arranged along the back side of the W-shaped cartridge.

With reference first made to FIGS. 1 and 3, it will be seen that a multi-purpose miniature flashlight 10 is shown in section and having a flexible outer casing 11 associating with a cap 12 that is removably arranged at one end and a central aperture allowing for the projection of a lamp 13 therethrough. At the bottom of the flexible case 11, a bottom cap 14 is provided. The bottom cap 14 in this embodiment may either be affixed to the casing 11 or made to be removable, such as by means of a friction fit grip around the flexible case 11. A W-shaped battery cartridge 15 is enclosed by the case 11 and provides a pair of battery-holding portions formed by the troughs of the W-shape for the retention of batteries 16 and 17. Batteries 16 and 17 are shown to be of the uninsulated variety whereby the cannister of the battery is a negative terminal and the positive terminal is noted at 18 for battery 16, and at 19 for battery 17, as would be understood. The ends of the batteries are resiliently grasped between a top end wall 20 and bottom end wall 21 of the cartridge 15. A pivotable spring switch arm means 22 electrically connects the positive terminal 18 to the negative cannister terminal of battery 17 upon pressing the flexible case 11. A slotted raised portion 23 of the bottom end wall 21 receives the positive terminal 18 in biased contact against a horizontal portion of the spring switch arm 22, which is also received within the slotted portion 23 in accordance with my said co-pending application. In the event that insulated batteries are utilized, a connector strip 22', shown in phantom lines, may be provided to extend from the bottom end negative terminal of battery 17 upwardly to be in the path of the switch arm means 22 in order to complete the circuit as the switch arm means 22 is squeezed downwardly by the user's hand.

Figure 2:
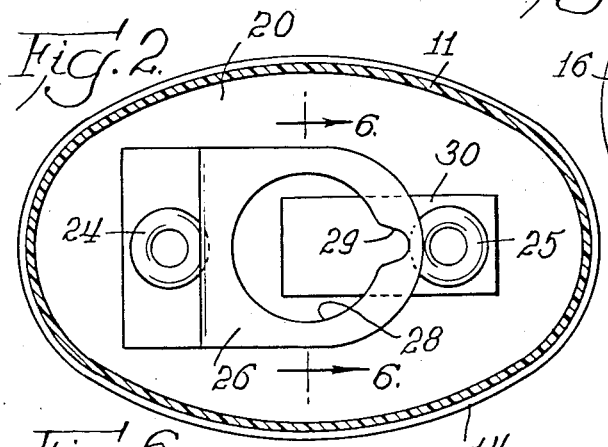
FIG. 2 is a sectional view of the inventive miniature flashlight along line 2—2 of FIG. 1 and showing a lamp bracket and battery terminal connector strip whereby the lamp is in electrical communication with the batteries.
Figure 6:
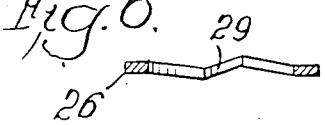
FIG. 6 is a sectional view of the lamp bracket of the invention taken along line 6—6 of FIG. 2 and showing a relief notch provided in the base-engaging portion of the bracket whereby screw-engagement of the threaded lamp base is facilitated.

The electrical communication between the batteries 16 and 17 and the lamp 13 is provided by contacts 24 and 25 which extend through the top wall 20 axially of the batteries 16 and 17, respectively. These contacts are preferably made of brass and have a conventional rivet-type design to extend through the top end wall 20 of the cartridge 15. The lamp 13 is mounted on a bracket 26 at a threaded base portion 27 engaged with a generally circular aperture 28 of the bracket 26. The aperture 28 includes a relief notch 29, best viewed in FIGS. 2 and 6, so that during the clockwise thread-engagement of the lamp base, the leading thread of the helix wedges the forward side of the notch up while the following thread wedges the other side of the notch down. FIG. 6 best illustrates how the bracket distorts in this manner to facilitate the thread-engagement. The bracket 26 is generally Z-shaped and is connected to the contact 24 whereby the lamp 13 is in communication with the battery 16. A connector strip 30 extends from contact 25 to the bottom center positive contact of the lamp to connect the battery 17 to the lamp so that upon the depression of switch arm means 22, the electric circuit is completed between the lamp 13 and batteries 16 and 17 to illuminate the lamp.

Figure 4:
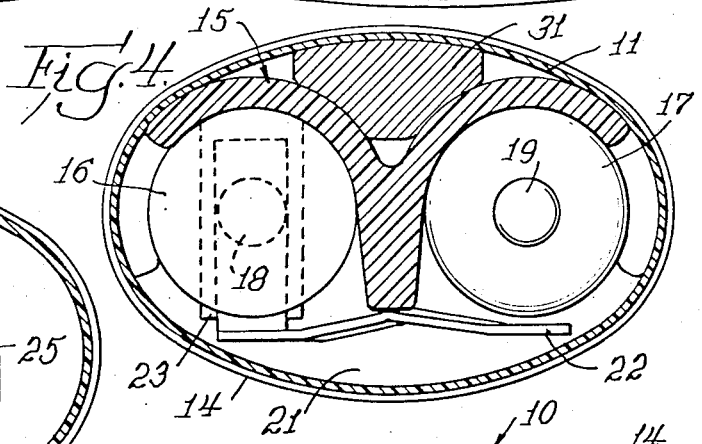
FIG. 4 is a sectional view of the invention taken along line 4—4 of FIG. 1 and showing the arrangement of the cartridge, flexible jacket and mounting magnet.

As is shown in FIG. 3, the spring switch arm means 22 is intermediately bent to provide a fulcrum-like central portion positioned to also pivotally contact atop the crest of the W-shape, as best seen in FIG. 4. Thereby, as explained in my said co-pending application, accidental illumination of the lamp is substantially eliminated and a self-cleaning action for the battery terminal 18 is achieved since the horizontal portion of the switch arm means 22 experiences a lateral chafing movement against the positive terminal 18 of battery 16 as the spring switch arm means 22 is squeezed, pivoted, and then released.

With further reference to FIG. 4, it will be seen that a mounting magnet 31 is provided to reside at the battery-opposite side of the W-shaped cartridge 15. The magnet 31 is provided to have a shape conforming to the backside of the W-shape and the interior curved surface of the flexible case 11. Preferably, the magnet 31 extends for substantially the full length of the cartridge 15, as best viewed in FIG. 3, whereby to provide strong magnetic attraction enabling the removable mounting of the flashlight 10 onto a refrigerator door, automobile dashboard, metal cabinet, etc.

Figure 5:
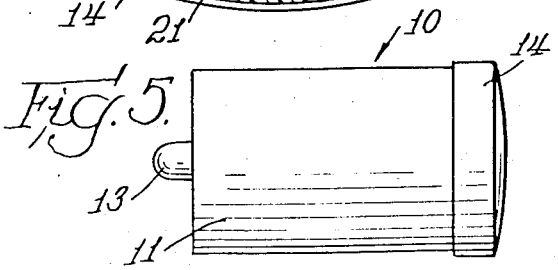
FIG. 5 is a plan view of the miniature flashlight of FIG. 1 in accordance with the invention.

FIG. 5 shows the assembled flashlight 10 in plan view, where, in the illustrative embodiment, the length of the flashlight 10 is about 2 inches and the width is about 1 3/16 inches. The thickness of the flashlight 10 is about ¾ of an inch, or slightly less. Accordingly, flashlight 10 is miniature for easy carrying and very useful by virtue of providing for the removal and replacement of a burned out lamp 13, or expended batteries 16 and 17, wherein the cartridge, with the electrical components, may be conveniently slid outwardly of the case 11 following the removal of the bottom cap 14 or top cap 12, as shown. Furthermore, all these goals are accomplished in a solderless arrangement that is thereby economical to manufacture and assemble. It will be clear that either of the caps 12 or 14 may be made removable while the other may be made fixed in place. If desired, both may be made removable, although only one is required to be removed in order to replace the batteries or lamp.

FIGS. 7–12 illustrate an alternate embodiment for the removable lamp provision of the invention, also including time piece means, and a mounting magnet feature similar to that shown in FIGS. 1–6.

Figure 7:
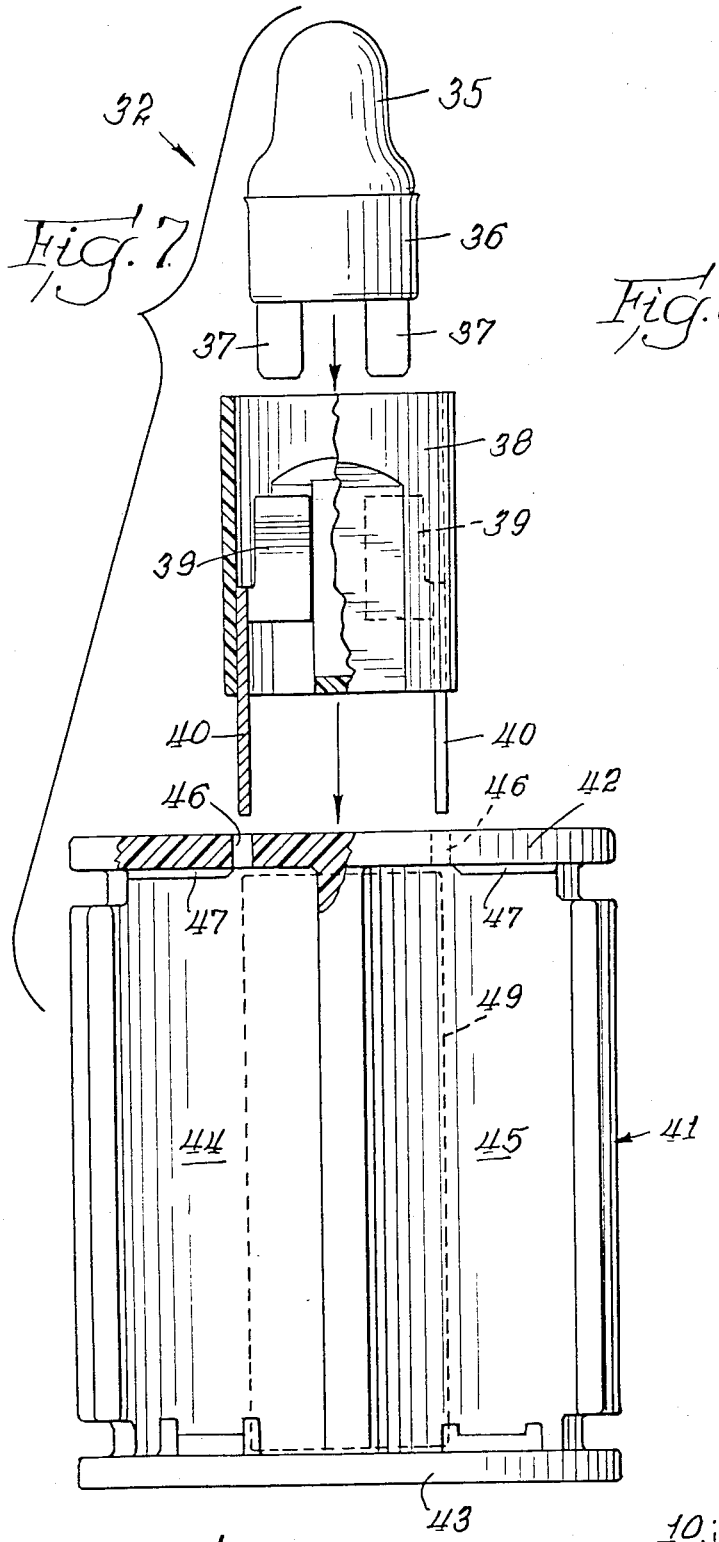
FIG. 7 is a sectional exploded view of an alternate embodiment of the invention similar to FIG. 1 showing a lamp, socket means and cartridge, and wherein a flexible jacket, which would be identical to that as shown in FIG. 1, has been deleted for the purpose of illustration.
Figure 8:
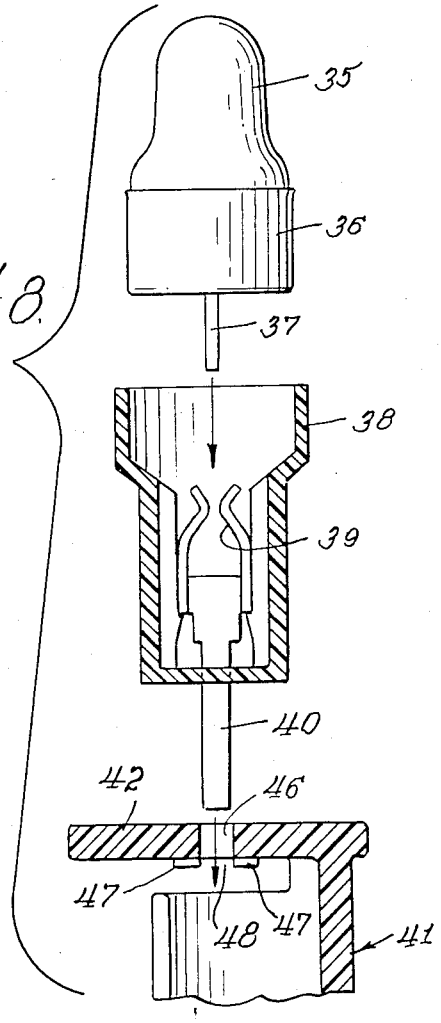
FIG. 8 is a partial sectional view looking from the side of the invention as shown in FIG. 7 showing spade-like connector blades of the lamp ready for insertion into snap connectors of a socket means, and the socket means being positioned for the entrance of its bendable leads interiorly of the cartridge to facilitate electrical communication with batteries to be placed therein.
Figure 9:
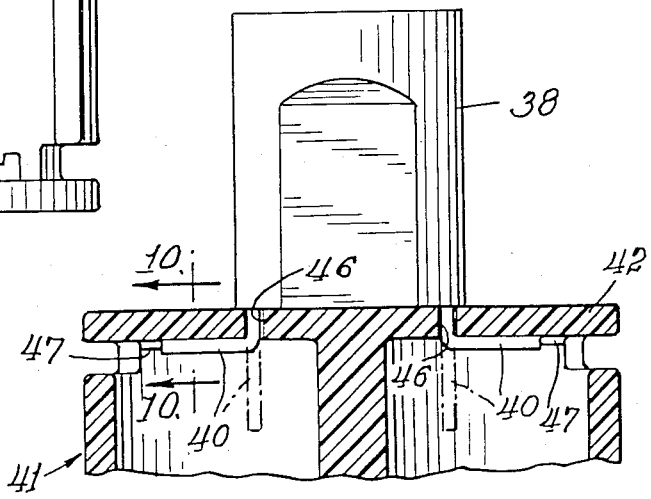
FIG. 9 is a sectional view similar to FIG. 7 showing the assembled engagement of the socket means with the upper end wall of the cartridge.
Figure 10:
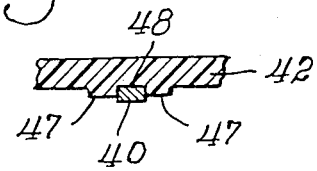
FIG. 10 is a sectional view taken along line 10—10 of FIG. 9 and illustrating the bendable lead of the socket means disposed within groove means of the upper end wall of the cartridge whereby to be positioned for electrical communication with a battery therebelow.
Figure 11:
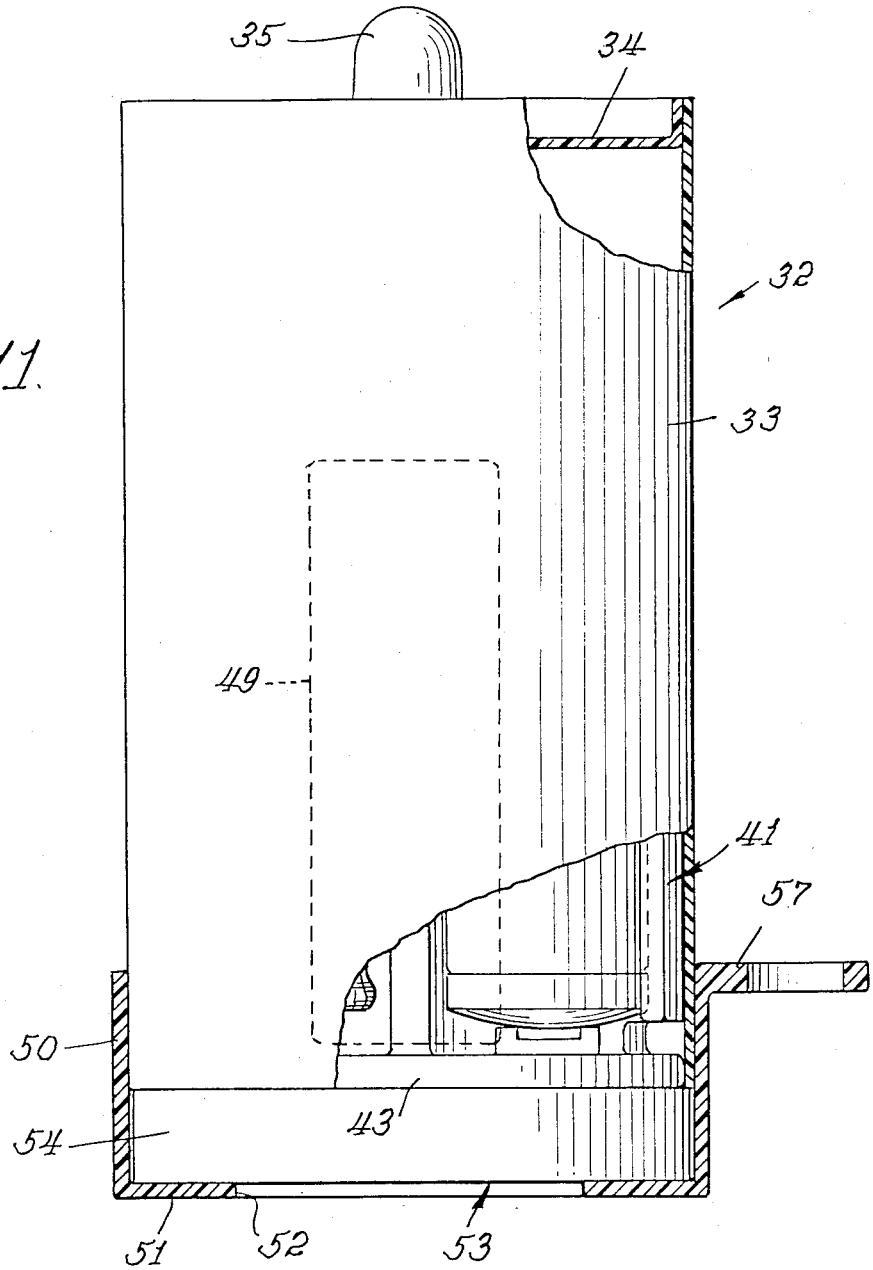
FIG. 11 is an elevational view, partially broken away, of an alternative embodiment of the miniature flashlight, also showing, in section, a bottom cap portion cooperative with the flexible jacket whereby to provide a downwardly open chamber for the nesting accommodation of a digital watch between the centrally open bottom wall of the cartridge and the bottom end wall of the cap member; and, FIG. 12 is bottom view of the miniature flashlight as shown in FIG. 11 illustrating the arrangement of the digital watch with the centrally open bottom cap member.
Figure 12:
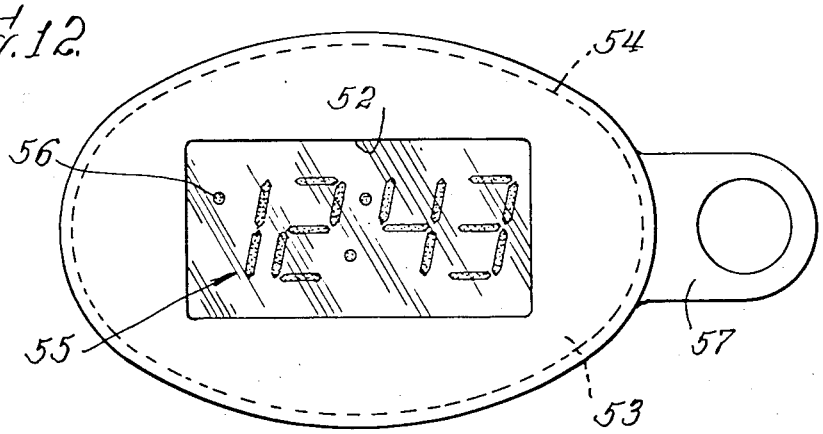

With reference first made to FIG. 11, it will be observed that a multi-purpose miniature flashlight 32 has a flexible case 33 covered by a top cap 34 having a central opening for the projection of a lamp 35 therethrough. With further reference now made to FIGS. 7–9, the lamp 35 has a different construction than the lamp 13 for flashlight 11. The lamp 35 has a circular base 36 and extending downwardly therefrom a pair of blade, or spade-like, connectors 37, which provide for the electrical connection of the lamp to a socket means 38 therebelow. The socket means 38 nests the base 36 at a correspondingly shaped circular top portion thereof and includes a pair of snap-connectors 39 for a resilient engagement with the connector blades 37. The snap-connectors 39 are each formed with bendable leads 40 that project outwardly of the socket means 38.

Residing within the flexible case 33 is a cartridge 41 that is W-shaped in section similar to cartridge 15 of flashlight 10 and includes a top end wall 42 and bottom end wall 43 capable of resiliently retaining batteries therebetween in the cradle-like portions 44 and 45 formed by the curved troughs of the W-shape. Associating with each of the cradle-like portions are holes 46 extending through the top end wall 42 and separated by substantially the same distance as the bendable leads 40. Thereby, the bendable leads 40 of the socket means 38 may extend through the holes 46 so that each may be disposed against a battery, as best viewed in FIG. 7. Along the interior of the top end wall 42, parallel raised strips 47 are provided to be spaced apart whereby to form a groove 48 therebetween above each battery cradle. Following insertion through the apertures 46, the bendable leads 40 are then outwardly bent to place them within the grooves 48. As would be clear, grooves 48 are not as deep as the thickness of the bendable leads 40 so that the leads 40 project below the raised strips 47 in order to make secure electrical communication with the batteries, as best observed in FIG. 9 and the sectional view of FIG. 10. The cartridge 41 also associates with a spring switch arm means (not shown) similar to switch arm means 22 of FIG. 1 facilitating the selected completion of the electrical circuitry and illumination of the lamp by squeezing the case 33.

With reference to FIGS. 7 and 11, it will be seen that a mounting magnet 49 is arranged at the battery-opposite side of cartridge 41 in substantially identical fashion to the disposition of magnet 31 for flashlight 11. If desired, the magnet 49 may be secured, such as by an adhesive, to the backside of the cartridge 41.

With specific reference now made to FIG. 11, it will be seen that the casing 33 is partially shown in section at a bottom cap 50 thereof. The bottom cap 50 is provided to extend for a distance below the bottom edge of the case 33 and below the bottom wall 43 of cartridge 41 whereby to create a time piece chamber between the bottom wall 51 of the cap 50 and the bottom end wall 43 of the cartridge 41. The bottom wall 51 is further provided with a large, correspondingly oval-shaped, opening therethrough. Within the spacing between the bottom wall 51 and bottom wall 43, there is provided in the illustrated embodiment, a digital watch 53 having an exterior casing 54 in a shape conforming to the interior curvature of the bottom cap 50 and of a sufficient thickness to be snugly maintained between the bottom end wall 43 of the cartridge and the bottom wall 51 of the cap 50. In preferred form, the bottom cap 50 is frictionally fit over the case 33 whereby to be removable in order to either remove and replace the digital watch 53, or to remove the cartridge, for the replacement of expired batteries or a burned-out lamp.

The digital watch 53 may be of a conventional construction and include a digital time display 55 having an AM/PM light 56. The digital watch 53 desirably includes its own separate battery to be operative independently of the batteries contained in the cartridge 41 for the illumination of lamp 35. A non-electric wind-up-type watch may also be employed, and the wind-up stem thereof could be designed to extend outwardly of the bottom cap 50.

The bottom cap 50 may be optionally provided with a keychain holder flange 57 extending outwardly therefrom so that a very useful multi-purpose miniature flashlight and key-holding device is provided. It will be seen that not only can the user illuminate a lock, or the like, to be opened with keys held by the key chain holder 57, but is also able to store the flashlight against a metal wall, automobile dashboard, etc., made possible by means of a relatively large sized mounting magnet having a magnetic attraction strength sufficiently powerful to support a plurality of keys on a keychain. Optionally, a watch means can be conveniently located at the base of the flashlight 32 adjacent the open bottom cap 50 and nested within a chamber formed between the bottom end wall of the cartridge and bottom wall of a removable cap 50.

The removable lamp assemblies in the preferred embodiment shown in FIG. 1 and the alternate embodiment shown in FIG. 7, are both usable with the cartridges having the W-shaped cross-sectional configuration of cartridges 15 and 41, and are also capable of being used with other shapes, such as the S-shaped cartridge disclosed in my above-mentioned co-pending application. Likewise, the accommodation of a digital watch between a bottom cap and the lower wall of the cartridge may be provided with either the W-shape, or an alternate shape, including an S-shaped cartridge.

The mounting magnet 31 for flashlight 10 may be secured to the back of the W-shaped cartridge 15 or, since the magnet can be quite large and extend for the full cartridge length, it can simply be nestably held between the flexible case 11 and back of the cartridge as shown in FIG. 4. If the mounting magnet is selected to be shorter than the cartridge length, securement of the magnet, such as with an adhesive, may be desired to avoid the possiblity of the magnet sliding up and down along the back of the cartridge.

It will be clear to those skilled in the art that various omissions, sustitutions, and changes in the form and detail of the invention as described herein may be made without departing from the true spirit and scope of the invention as defined by the appended claims. Therefore, it is the intention of the inventor that the invention be limited only by the scope of the following claims.

What is claimed is:

1. A multi-purpose miniature pocket flashlight comprising a cartridge having top and bottom end wall means, capable of being accommodated within a flexible casing, and having means for holding a pair of batteries between said top and bottom end wall means;

the top end wall means including metal contacts extending therethrough to be in communication with each battery;

one said contact communicating with a bracket, the bracket extending upwardly from the top end wall, said other contact communicating with a metallic connector strip;

a lamp removably mounted to said bracket and having a bottom center contact thereof in communication with the metallic connector strip;

spring switch arm means electrically communicating with the positive terminal of one said battery, whereby upon squeezing the flexible casing, the spring switch arm means is capable of completing electrical continuity with the negative terminal of the other said battery whereby to illuminate the light;

a flexible casing accommodating said cartridge therein, said flexible casing having a top cap and a bottom cap, said top cap having an aperture for the lamp to project outwardly therethrough in order to illuminate the surrounding area, one of said caps being removable whereby to grant access to the interior of the casing and permit the removal of the cartridge, lamp, batteries, and spring arm, as a unit therefrom; and, mounting magnet means arranged between said cartridge and said flexible case whereby to permit said miniature flashlight to be magnetically mounted to metallic surfaces.

2. The multi-purpose miniature pocket flashlight as claimed in claim 1 wherein said bracket includes a circular opening therethrough and said lamp base is threaded.

3. The multi-purpose miniature pocket flashlight as claimed in claim 2 wherein said circular opening through said bracket includes a relief notch whereby to facilitate thread engagement with the threaded lamp base.

4. The multi-purpose miniature pocket flashlight as claimed in claim 1 wherein said cartridge is generally W-shaped in cross section having a battery-holding cradle side and wherein said mounting magnet is arranged at the side of the cartridge opposite the battery-holding cradle side.

5. The multi-purpose miniature pocket flashlight as claimed in claim 1 wherein said bottom cap includes a keychain holder flange for connection thereat of a keychain or the like.

6. A multi-purpose miniature pocket flashlight comprising a flexible casing having a bottom cap and top cap one of which is removable;

a cartridge arranged within the flexible casing, said cartridge having cradle means for holding two batteries of either the insulated or uninsulated variety between opposing top and bottom end walls, said top end wall having apertures therethrough opening to said cradle means;

a lamp assembly including a lamp having a base terminating in two-blade-like connectors extending therefrom and socket means including snap-connectors for the engagement of said blade-connectors of the lamp, said socket means further including lead means extending from said snap-connectors and being spaced apart sufficiently whereby to be capable of being extended through said apertures of the top end wall and thereafter bent against the interior of said top end wall whereby to be held thereat for electrical communication with batteries held by said cradle means;

a spring switch arm means capable of electrically connecting the positive terminal of one battery to the negative terminal of the other battery by squeezing said flexible casing; and, a mounting magnet arranged between said flexible casing and cartridge whereby said miniature pocket flashlight may be magnetically mounted to metallic surfaces for storage.

7. The multi-purpose miniature pocket flashlight as claimed in claim 6 wherein said top end wall of the cartridge includes groove means for the accommodation therein of said leads whereby to secure said leads adjacent the ends of said batteries.

8. The multi-purpose miniature pocket flashlight as claimed in claim 6 wherein said cartridge, lamp assembly and batteries are removable from said flexible casing as a unit whereby a burned-out lamp or an expended battery may be replaced.

9. The multi-purpose miniature pocket flashlight as claimed in claim 6 wherein said bottom cap includes a bottom wall having a central opening therethrough and the cap is of a size providing a space between the bottom wall of the cap and said bottom end wall of the cartridge whereby to form a chamber therebetween, a watch means nested within said chamber and having a shape conforming to the interior of said bottom cap and having a time display means arranged adjacent the opening in the bottom wall to be visible from the bottom of said flashlight, said watch means including operating means self-contained therein separate from said lamp illuminating circuit.

10. The multi-purpose miniature pocket flashlight as claimed in claim 6 wherein said bottom cap includes a keychain holder flange for the connection thereat of a keychain means or the like.

11. The multi-purpose miniature pocket flashlight as claimed in claim 6 wherein said batteries are of the uninsulated variety whereby the spring switch arm means flexes when said flexible case is squeezed to contact the exterior battery jacket of one battery generally at one end thereof and generally at an opposite end thereof makes contact with the positive center post terminal of the other said battery to complete said circuit.

12. The multi-purpose miniature pocket flashlight as claimed in claim 6 wherein said batteries are of the insulated jacket variety wherein generally at one end thereof said spring switch arm means contacts the center positive post terminal of one battery and wherein upon squeezing the flexible jacket the switch arm means bends generally centrally therealong so that generally at the opposite end thereof the switch arm means contacts a connector strip extending from the negative end terminal of the other battery whereby the electrical circuit is completed to illuminate the lamp.

13. A multi-purpose miniature pocket flashlight having a cartridge, a pair of batteries held by the cartridge, spring switch arm means mounted with the cartridge, and a lamp assembly mounted to the cartridge, all connections are solderless, and said elements being supported by the cartridge as a unit and contained within a flexible casing, said cartridge unit capable of being removed from at least one end of said casing, said casing including a bottom cap and top cap, one of which being frictionally fit and removable to facilitate the removal of the cartridge unit, said flashlight further including a mounting magnet disposed between said cartridge and said flexible casing whereby the flashlight may be magnetically held against metallic surfaces and wherein the bottom cap of said flashlight is of a depth sufficient to provide a watch chamber below said cartridge, said bottom cap having an opening therethrough, a watch means housed within said watch chamber and having a time display means arranged at said bottom wall opening whereby to be observable from the bottom of said flashlight, said watch means having operative power means independent of said batteries.

14. The multi-purpose miniature pocket flashlight as claimed in claim 13 wherein said lamp assembly includes a thread-engageable bracket mounted to the cartridge and the lamp includes a threaded base whereby the lamp engages said bracket, said bracket electrically communicates with one said battery, and a bottom center contact of said threaded base electrically communicates with a connector strip, the connector strip mounted to the cartridge and arranged to be in electrical contact with the other said battery.

15. The multi-purpose miniature pocket flashlight as claimed in claim 13 wherein said lamp assembly comprises a lamp having blade-like connectors insertable into snap-connectors of a socket means, the socket means including bendable leads capable of extending into said cartridge to be in electrical communication with the negative and positive terminals of said batteries.

16. The multi-purpose miniature pocket flashlight as claimed in claim 13 wherein said bottom cap includes a keychain holder flange adapted to be engaged by a keychain or the like.

* * * * *